US009227699B2

(12) United States Patent
Raiter et al.

(10) Patent No.: US 9,227,699 B2
(45) Date of Patent: Jan. 5, 2016

(54) BOAT COVER ASSEMBLY

(71) Applicant: Larson Boats, LLC, Hopkins, MN (US)

(72) Inventors: Leon C. Raiter, Sartell, MN (US); Luc St-Onge, Trois-Rivieres (CA); Ron Sahr, Cushing, MN (US); Chris Backowski, Cushing, MN (US); Rich Farrier, Little Falls, MN (US)

(73) Assignee: Larson Boats, LLC, Hopkins, MN (US)

( * ) Notice: Subject to any disclaimer, the term of this patent is extended or adjusted under 35 U.S.C. 154(b) by 99 days.

(21) Appl. No.: 14/060,267

(22) Filed: Oct. 22, 2013

(65) Prior Publication Data

US 2014/0109816 A1 Apr. 24, 2014

Related U.S. Application Data

(60) Provisional application No. 61/867,300, filed on Aug. 19, 2013, provisional application No. 61/716,804, filed on Oct. 22, 2012.

(51) Int. Cl.
*B63B 17/02* (2006.01)
*B63B 17/00* (2006.01)
*B63B 1/12* (2006.01)

(52) U.S. Cl.
CPC .. *B63B 17/02* (2013.01); *B63B 1/12* (2013.01)

(58) Field of Classification Search
CPC ..... B63B 17/02; B63B 1/12
USPC ..... 114/361, 61.1
See application file for complete search history.

(56) References Cited

U.S. PATENT DOCUMENTS

| | | | | |
|---|---|---|---|---|
| 2,821,989 | A | 2/1958 | Shepard | |
| 3,312,990 | A * | 4/1967 | Lapworth | 114/361 |
| 6,357,379 | B1 * | 3/2002 | Murphy, Jr. | 114/361 |
| 6,725,796 | B2 * | 4/2004 | Mensch | B63C 13/00 114/344 |
| 7,107,926 | B2 | 9/2006 | Fishburn | |
| 7,520,240 | B2 | 4/2009 | Tufte | |
| 7,571,691 | B2 | 8/2009 | Russikoff | |
| 7,895,964 | B2 | 3/2011 | Russikoff | |
| 8,056,495 | B2 | 11/2011 | Lemons | |
| 2003/0217683 | A1 * | 11/2003 | Heckman | 114/361 |

* cited by examiner

*Primary Examiner* — Anthony Wiest
(74) *Attorney, Agent, or Firm* — Merchant & Gould P.C.

(57) ABSTRACT

A pontoon boat includes a cover assembly. A front cover section has a front cover area defined by a perimeter thereof and is slidable relative to the central cover section between a retracted position and an extended position. An aft cover section has an aft cover area defined by a perimeter thereof and is slidable relative to the central cover section between a retracted position and an extended position. When in the extended position, the cover assembly defines a perimeter having a length dimension and a width dimension generally matching the length and width dimensions of the perimeter defined by the pontoon's sidewalls. The cover assembly is vertically movable between an up position where the cover assembly is elevated above head level, and a down position where the cover assembly is positioned on the sidewalls to cover an area inside the perimeter defined by the sidewalls.

19 Claims, 9 Drawing Sheets

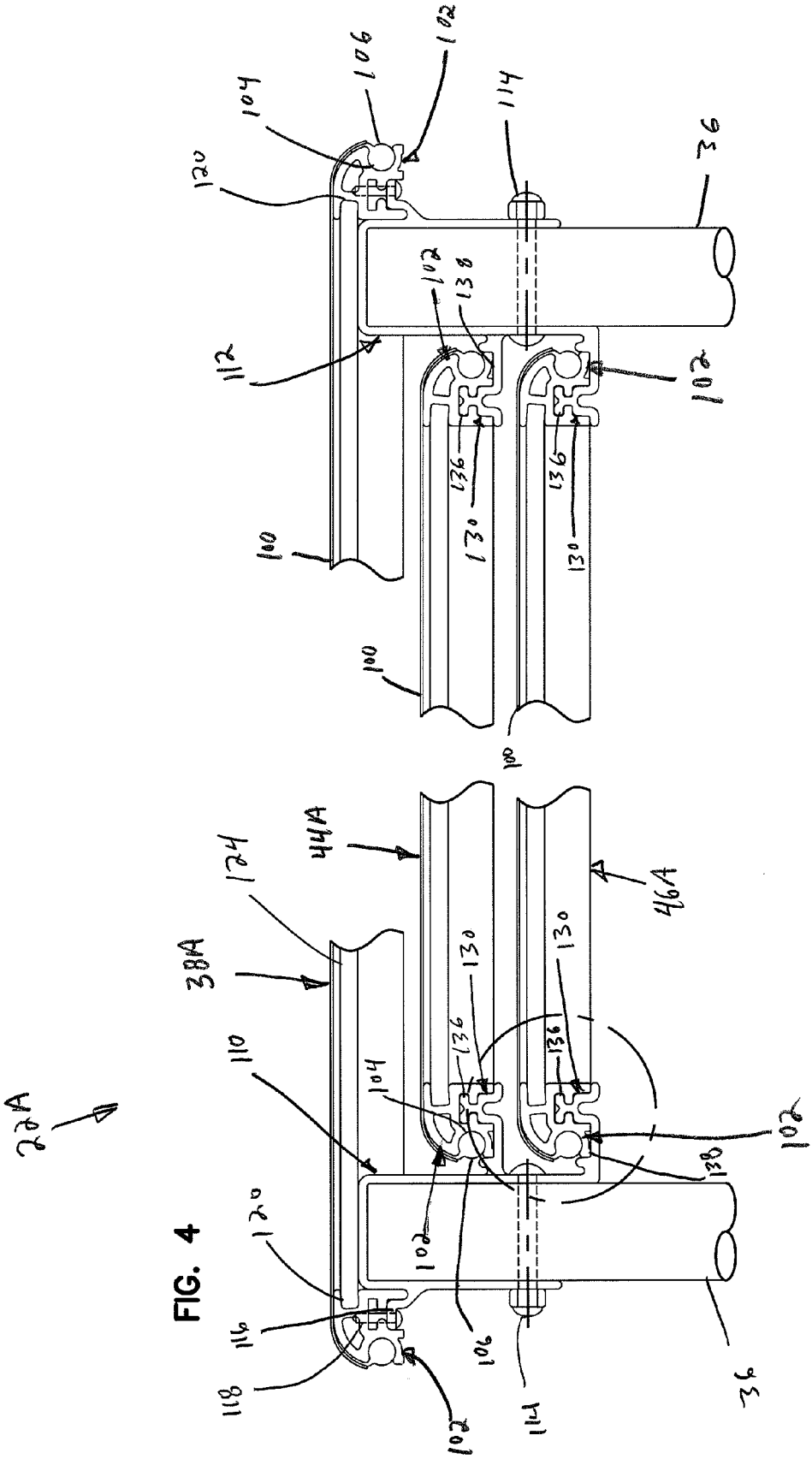
20A
38A
44A
44A
124
110
120
118
116
102
104
106
102
112
100
100
102
102
102

BOAT COVER ASSEMBLY

CROSS-REFERENCE TO RELATED APPLICATIONS

The present application claims the benefit of U.S. Provisional Patent Application Ser. No. 61/867,300, filed Aug. 19, 2013 and also claims the benefit of U.S. Provisional Patent Application Ser. No. 61/716,804, filed Oct. 22, 2012, which applications are hereby incorporated by reference in their entireties.

TECHNICAL FIELD

The present disclosure relates generally to boat covers. More particularly, the present disclosure relates to boat covers moveable between retracted (e.g., stowed) and extended (e.g., deployed) positions.

BACKGROUND

During boating, sun exposure can be a serious concern. To address this concern, many boats are equipped with covers (e.g., bimini-type top covers). Example boat covers are disclosed by U.S. Pat. Nos. 2,821,989; 7,107,926; 7,571,691; 7,895,964; and 8,056,495.

SUMMARY

One aspect of the present disclosure relates to a boat cover assembly that can quickly and easily be manually moved between a refracted configuration and an extended configuration, and that provides a substantial coverage area in the extended configuration. In certain embodiments, the boat cover assembly has a simple, robust design having a relatively low number of movable parts.

Another aspect of the present disclosure relates to a boat cover assembly that attaches to a frame structure (e.g., an arch) configured for elevating the boat cover assembly over a deck of the boat. Preferably, the boat cover assembly is elevated above head level such that boaters can walk beneath the boat cover assembly. The boat cover assembly includes a central cover section mounted to the frame structure. The central cover section includes a front end and an aft end. The boat cover assembly also includes a front cover section having a front cover area defined by a perimeter of the front cover section. The front cover section is slidable relative to the central cover section between a refracted position where at least a majority of the front cover area is beneath the central cover section and an extended position where at least a majority of the front cover area extends forwardly from the front end of the central cover section. The front cover section is configured such that the front cover area does not change when the front cover section is slid between the retracted and extended positions. The boat cover assembly also includes an aft cover section having an aft cover area defined by a perimeter of the aft cover section. The aft cover section is slidable relative to the central cover section between a retracted position where at least a majority of the aft cover area is beneath the central cover section and an extended position where at least a majority of the aft cover area extends rearwardly from the aft end of the central cover section. The aft cover section is configured such that the aft cover area does not change when the aft cover section is slid between the retracted and extended positions.

Still further aspects of the present disclosure relate to a pontoon boat that has a deck supported by a plurality of sponsons with sidewalls extending upwardly from the deck to define a perimeter having a length dimension and a width dimension. A cover assembly includes a central cover section that is mounted to a frame structure. A front cover section is slidable relative to the central cover section between a retracted position where at least a majority of the front cover area is beneath the central cover section and an extended position where at least a majority of the front cover area extends forwardly from the front end of the central cover section. An aft cover section is slidable relative to the central cover section between a retracted position where at least a majority of the aft cover area is beneath the central cover section and an extended position where at least a majority of the aft cover area extends rearwardly from the aft end of the central cover section. When in the extended position, the cover assembly defines a perimeter having a length dimension and a width dimension generally matching the length and width dimensions of the perimeter defined by the sidewalls. The cover assembly is vertically movable between an up position where the cover assembly is elevated above head level, and a down position where the cover assembly is positioned on the sidewalls to cover an area inside the perimeter defined by the sidewalls.

A variety of additional aspects will be set forth in the description that follows. These aspects can relate to individual features and to combinations of features. It is to be understood both the foregoing general description and the following detailed description are exemplary and explanatory only and are not restrictive of the broad concepts upon which the embodiments disclosed herein are based.

BRIEF DESCRIPTION OF THE DRAWINGS

FIG. 4 is a cross-sectional view showing a boat cover assembly in accordance with the principles of the present disclosure having a canvas (e.g., fabric, polymeric flexible sheet, etc.) construction;

DETAILED DESCRIPTION

Figure 1:
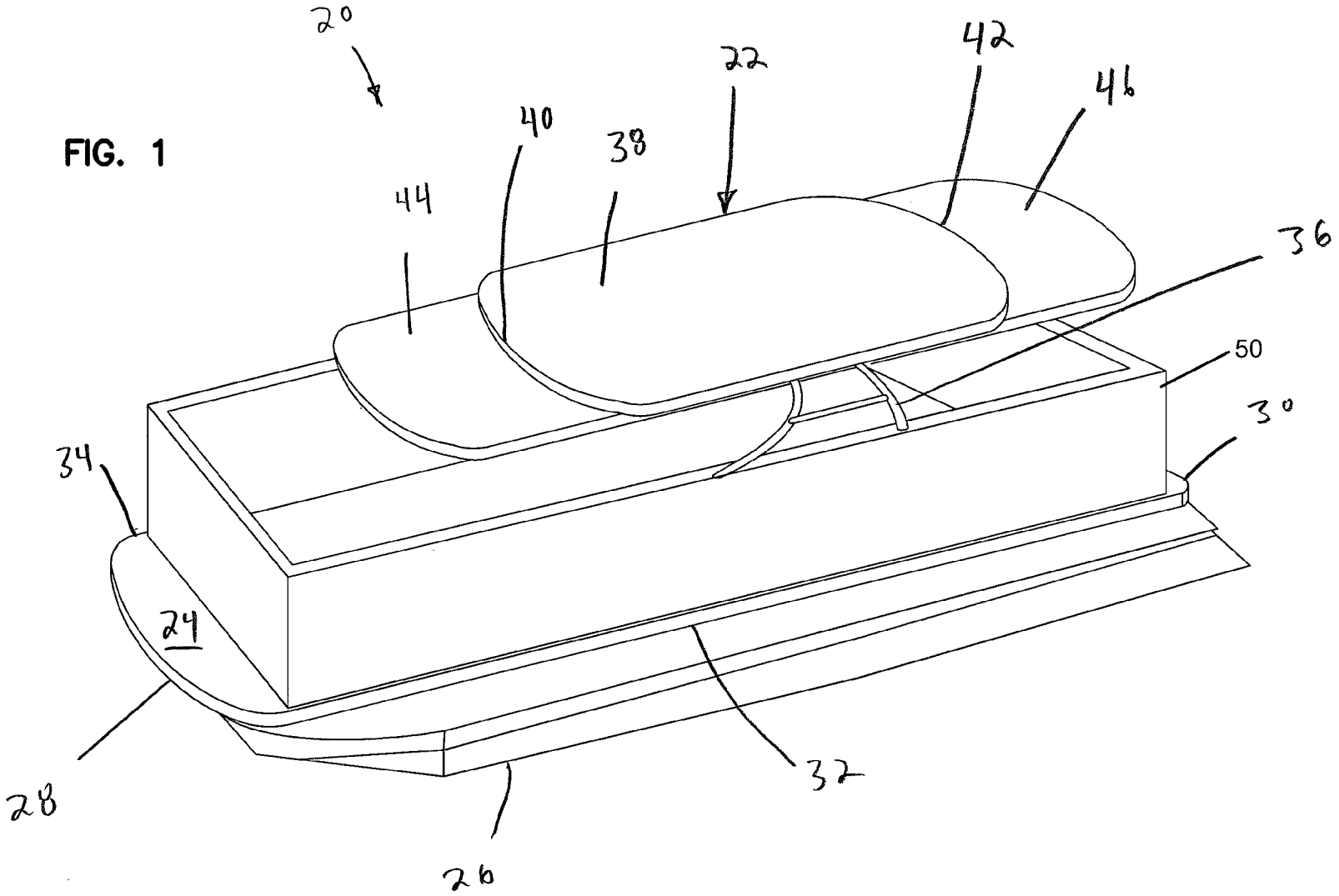
FIG. 1 is a perspective view of a pontoon boat including a boat cover assembly in accordance with the principles of the present disclosure.

FIG. 1 illustrates a pontoon boat 20 having a boat cover assembly 22 in accordance with the principles of the present disclosure. The pontoon boat 20 includes a deck 24 supported on a plurality of sponsons 26. The pontoon boat 20 includes a bow 28, a stern 30, a port side 32 and a starboard side 34. A frame structure such as an arch 36 is mounted near a mid-region of the pontoon boat 20. The arch 36 extends across a width of the deck 24 between the port side 32 and the starboard side 34 of the pontoon boat 20. Preferably, the arch 36 extends to a height above head level (e.g., above six feet) so that boaters can easily walk beneath the arch 36. The boat cover assembly 22 is mounted to the arch 36 such that the boat cover assembly 22 is elevated above head level.

Referring still to FIG. 1, the boat cover assembly 22 includes a central cover section 38 mounted to the arch 36. In some embodiments, the central cover section 38 is fixedly mounted to the arch 36 (e.g., by fasteners) so that the central cover section 38 remains stationary relative to the arch 36 during use. In certain embodiments, the central cover section 38 has a length that extends along the length of the boat 20 and a width that extends across a width of the boat. In certain embodiments, a main body of the central cover section 38 is made of a flexible sheet of material (e.g., canvas) that is supported by a frame that extends around the perimeter of the central cover section 38. In certain embodiments, the frame can include a metal construction or a polymeric construction. Preferably, the frame is rigid enough to support the flexible main body of the central cover section 38. In other embodiments, the main body of the central cover section 38 can be formed of a hard panel material that is relatively rigid and self-supporting to as to form a hard top. The length of the central cover section 38 extends from a front end 40 to an aft end 42 of the central cover section 38.

Figure 2:
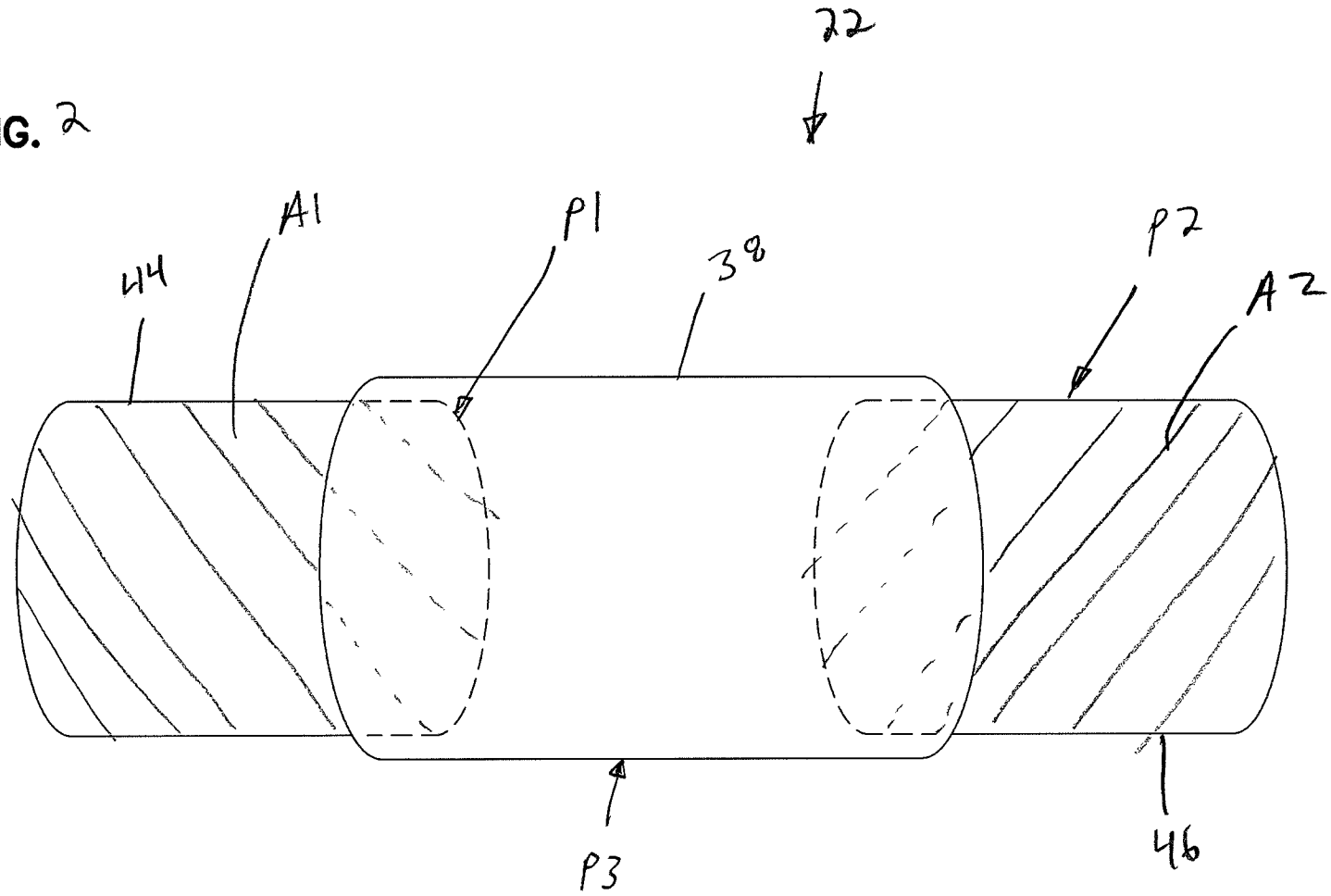
FIG. 2 is a schematic top plan view of the boat cover assembly of FIG. 1 shown in an extended (i.e., deployed) configuration.
Figure 3:
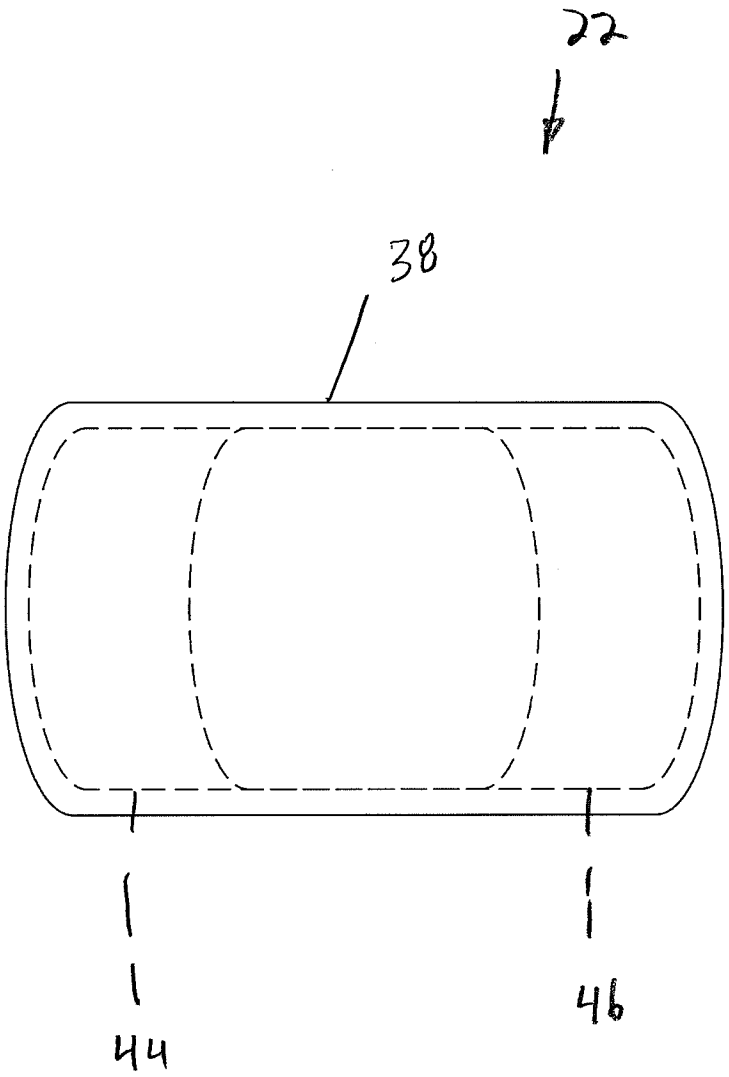
FIG. 3 is a schematic top plan view of the boat cover assembly of FIG. 1 shown in a retracted (i.e., stowed) configuration.

Referring to FIGS. 1-3, the boat cover assembly 22 also includes a front cover section 44 having a front cover area A1 (see FIG. 2) defined by a perimeter P1 of the front cover section 44. The front cover section 44 is slidable relative to the central cover section 38 between a refracted position (see FIG. 3) where at least a majority of the front cover area A1 is beneath the central cover section 38 and an extended position (see FIG. 2) where at least a majority of the front cover area A1 extends forwardly from the front end 40 of the central cover section 38. The front cover section 44 is configured such that the front cover area A1 does not change when the front cover section 44 is slid between the retracted and extended positions.

Still referring to FIGS. 1-3, the boat cover assembly 22 also includes an aft cover section 46 having an aft cover area A2 (see FIG. 2) defined by a perimeter P2 of the aft cover section 46. The aft cover section 46 is slidable relative to the central cover section 38 between a retracted position (see FIG. 3) where at least a majority of the aft cover area P2 is beneath the central cover section 38 and an extended position (see FIG. 2) where at least a majority of the aft cover area A2 extends rearwardly from the aft end 42 of the central cover section 38. The aft cover section 46 is configured such that the aft cover area A2 does not change when the aft cover section 46 is slid between the retracted and extended positions.

It will be appreciated that the front cover section 44 and the aft cover section 46 are configured such that the perimeters and areas of the cover sections 44, 46 are not compacted as the cover sections 44, 46 are moved from the extended positions to the retracted positions. For example, the front and aft cover sections 44, 46 are not rolled up, folded, bunched or otherwise compacted as the cover sections 44, 46 are moved from the extended positions to the retracted positions. Instead, the front and aft cover sections 44, 46 simply slide between the expanded and retracted positions without experiencing any change in their overall perimeter size or overall area size. In certain embodiments, the front and aft cover sections 44, 46 include at least portions that are relatively rigid and self-supporting. For example, the front and aft cover sections 44, 46 can include main bodies formed by a canvas material (e.g., a fabric material, a polymeric sheet material, etc.) supported by generally rigid frames that extend around the perimeters P1, P2 of the cover sections 44, 46. In other embodiments, the main bodies of the front and aft cover sections 44, 46 can be made of a relatively rigid material such as a hard top or hard panel, plastic or metal material.

As shown at FIG. 3, when both the front cover section 44 and the aft cover section 46 are in the retracted position, the front cover section 44 and the aft cover section 46 overlap one another beneath the central cover section 38. In certain embodiments, the front cover section 44 is stowed between the central cover section 38 and the aft cover section 46 when the boat cover assembly 22 is in the retracted configuration of FIG. 3. In other embodiments, the aft cover section 46 is stowed between the central cover section 38 and the front cover section 44 when the boat cover assembly 22 is in the retracted configuration of FIG. 3.

FIG. 4 is a cross-sectional view of a boat cover assembly 22A mounted to the arch 36. The boat cover assembly 22A includes a central cover section 38A, a front cover section 44A and an aft cover section 46A. The central cover section 38A, the front cover section 44A and the aft cover section 46A all have a construction including a main body 100 made of a canvas material supported by a perimeter frame 102 that extends around the perimeter of the main body 100. In embodiments as shown at FIGS. 1-3, the perimeter frame 102 is generally rectangular so as to follow the shape of the perimeters P1, P2 of the cover sections 44, 46. The perimeter frame 102 includes an outwardly facing channel 104 depicted as having a generally cylindrical cross-sectional shape with an outwardly facing open side. A keeper 106 is secured (e.g., sewn, adhesively bonded, etc.) along the outer edge of the main body 100. The keeper 106 is secured (e.g., snap-fit, press-fit, or otherwise secured) within the channel 104 to attach the main body 100 to the perimeter frame 102.

Referring still to FIG. 4, the central cover section 38A is secured to the arch 36 by a securement technique that prevents the central cover section 38A from moving or sliding relative to the arch 36. Thus, the central cover section 38A is a stationary cover section (i.e., a stationary top cover) and does not move relative to the arch 36 as the front and aft cover sections 44A, 46A are moved between the extended and refracted positions. As shown at FIG. 4, port and starboard extrusions 110, 112 are anchored to the arch 36 adjacent port and starboard sides of the pontoon boat 20. The port and starboard extrusions 110, 112 can have a metal or polymeric construction and are not preferably elongated in a direction that extends along the length of the pontoon boat 20. In certain embodiments, the port and starboard extrusions 110, 112 each have a unitary, one-piece construction. As depicted at FIG. 4, the port and starboard extrusions 110, 112 are anchored to the arch 36 by fasteners 114.

Still referring to FIG. 4, the port and starboard extrusions 110, 112 include top cover mounting flanges 116 positioned higher than the arch 36. The top cover mounting flanges 116 project outwardly from the arch 36 in opposite directions. For example, the top cover mounting flange 116 corresponding to the port extrusion 110 projects outwardly (i.e., in a port direction) from the port side of the arch 36 and the top cover mounting flange 116 corresponding to the starboard extrusion 112 extends outwardly (i.e., in a starboard direction) from the starboard side of the arch 36. Port and starboard side portions of the perimeter frame 102 of the central cover section 38A are anchored to the flanges 116. For example, fasteners 118 are used to anchor the port and starboard side portions of the perimeter frame 102 of the central cover section 38A to the flanges 116. The perimeter frame 102 also includes port and starboard slot structures 120 that receive ends of reinforcing members 124 (e.g., laths, slats, strips, etc.) that extend beneath the main body 100 and extend across the width of the perimeter frame 102 from a port side of the perimeter frame to a starboard side of the perimeter frame 102.

The front cover section 44A and the aft cover section 46A are preferably connected to the arch 36 by a slide system that allows the front and aft cover sections 44A, 46A to slide relative to the arch 36 along linear paths. In certain embodiments, the front and aft cover sections 44A, 46A remain in a generally horizontal plane as the front and aft cover sections 44A, 46A are moved between the extended and retracted positions.

Figure 4A:
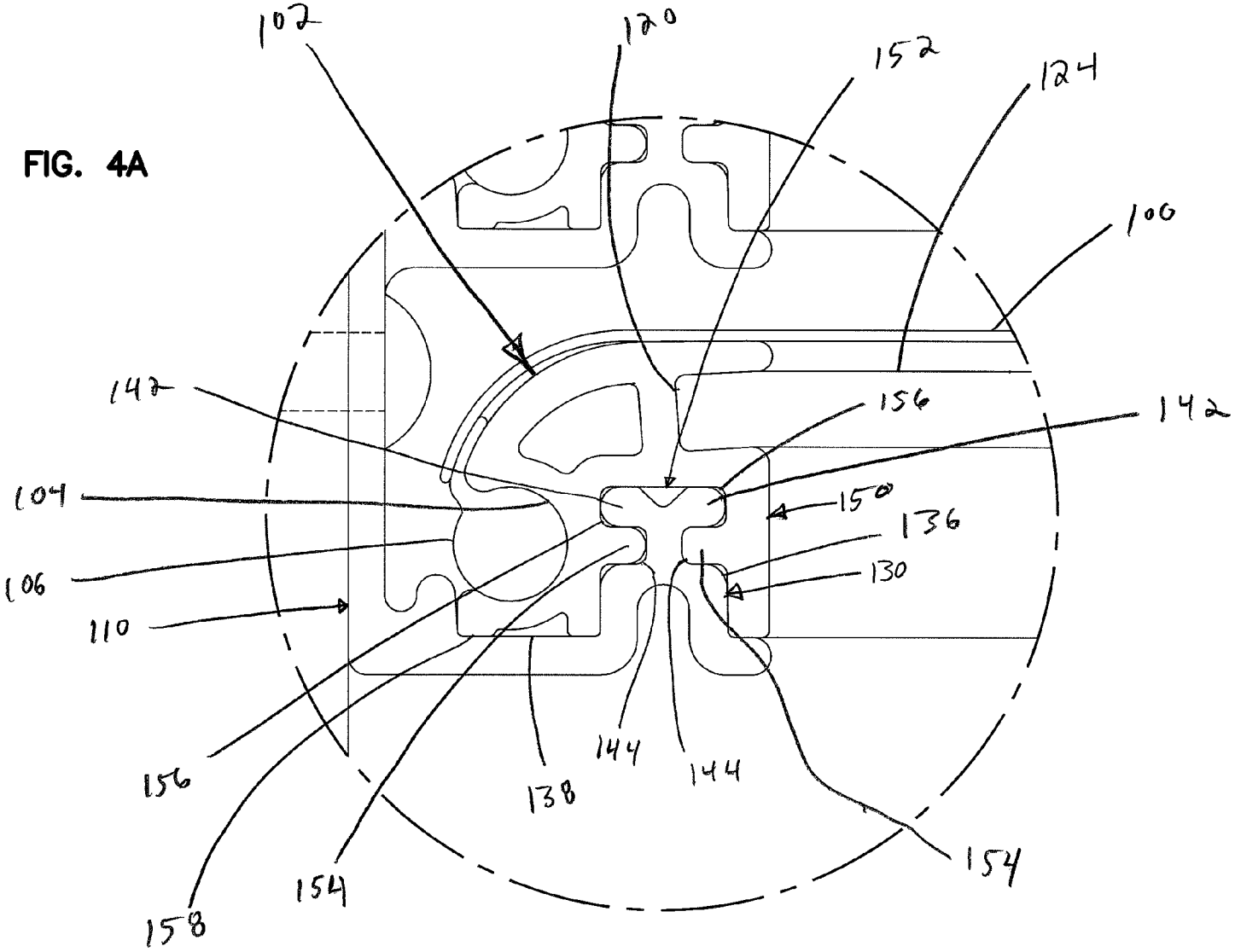
FIG. 4A is a close up view of a portion of the boat cover assembly shown in FIG. 4.

As shown at FIG. 4, the slide system includes upper and lower tracks 130 defined by the port extrusion 110 and upper and lower tracks 130 defined by the starboard extrusion 112. The upper tracks 130 form a first set of port and starboard tracks on which the front cover section 44A is mounted and the lower tracks 130 form a second set of port and starboard tracks on which the aft cover section 46A is mounted. The tracks 130 each include a male portion 136 and a female portion 138. The male portion 136 has a general T-shaped transverse cross-section while the female portion 138 has a generally rectangular shaped transverse cross-section. The T-shaped transverse cross-sectional shape is defined by a pair of lateral projections 142 positioned above a pair of lateral notches 144, as shown in the close up view of FIG. 4A. Port and starboard sides of the perimeter frames 102 of the front and aft cover sections 44A, 46A define slide structures 150 that slidably mount on the tracks 130. The slide structures 150 are elongated along the lengths of the perimeters of the front and aft cover sections 44A, 46A. The slide structures 150 define elongated channels 152 having T-shaped transverse cross-sectional shapes that complement and interlock with the male portions 136 of the tracks 130. The channels 152 include lateral projections 154 that fit within the lateral notches 144 of the tracks 130 and lateral notches 156 that receive the lateral projections 142 of the tracks 130. The lateral projections 142 of the tracks 130 are captured within the channels 152 by the lateral projections 154 of the slide structures 150. In this way, the slide structures 150 can slide longitudinally along the tracks 130, but are prevented from being unintentionally vertically lifted from the tracks 130 by interference between the lateral projections 142 of the tracks 130 and the lateral projections 154 of the slide structures 150. The slide structures 150 also include male portions 158 that seat within the female portions 138 of the tracks 130.

Figure 5:
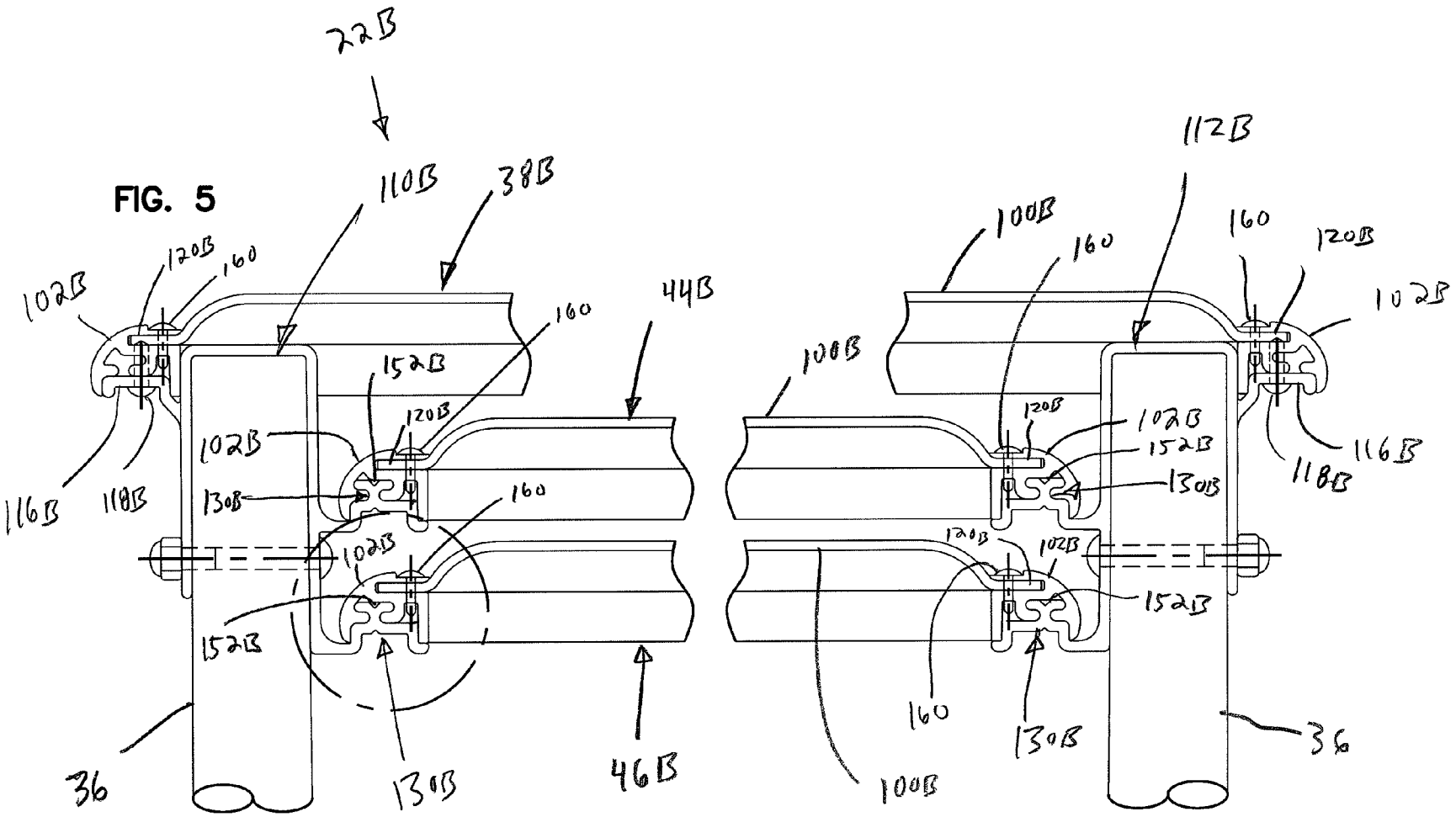
FIG. 5 is a cross-sectional view showing a boat cover assembly in accordance with the principles of the present disclosure having a hard panel construction.

FIG. 5 illustrates another boat cover assembly 22B in accordance with the principles of the present disclosure. The boat cover assembly 22B includes a central cover section 38B, a front cover section 44B and an aft cover section 46B. Each of the cover sections 38B, 44B and 46B has a main body 100B having a hard panel (i.e., a hard top) construction. The cover sections 38B, 44B and 46B also include perimeter frames 102B that surround at least portions of the main bodies 100B. The perimeter frames 102B can include elongated port and starboard sides defining port and starboard slot structure 120B in which port and starboard ends of the main bodies 102B are received. Fasteners 160 are used to anchor the port and starboard sides of the main bodies 102B within the port and starboard slot structures 120B.

Referring still to FIG. 5, the boat cover assembly 122B further includes port and starboard extrusions 110B, 112B. The port extrusion 110B is anchored to the arch 36 adjacent the port side 32 of the boat 20. The starboard extrusion 112B is anchored to the arch 36 adjacent the starboard side 34 of the boat 20. The port and starboard extrusions 110, 112 each include elongated top cover mounting flanges 116B located adjacent the top of the arch 36. The top cover mounting flanges are elongated along the length of the central cover section 38B. The top cover mounting flange 116B of the port extrusion 110B projects laterally outwardly from the port side of the arch 36 and the top cove mounting flange 116B of the starboard extrusion 112B projects laterally outwardly from the starboard side of the arch 36. The port and starboard sides of the perimeter frame 102B of the central cover section 38B are anchored to the top cover mounting flanges 116B by conventional techniques such as fasteners.

Figure 5A:
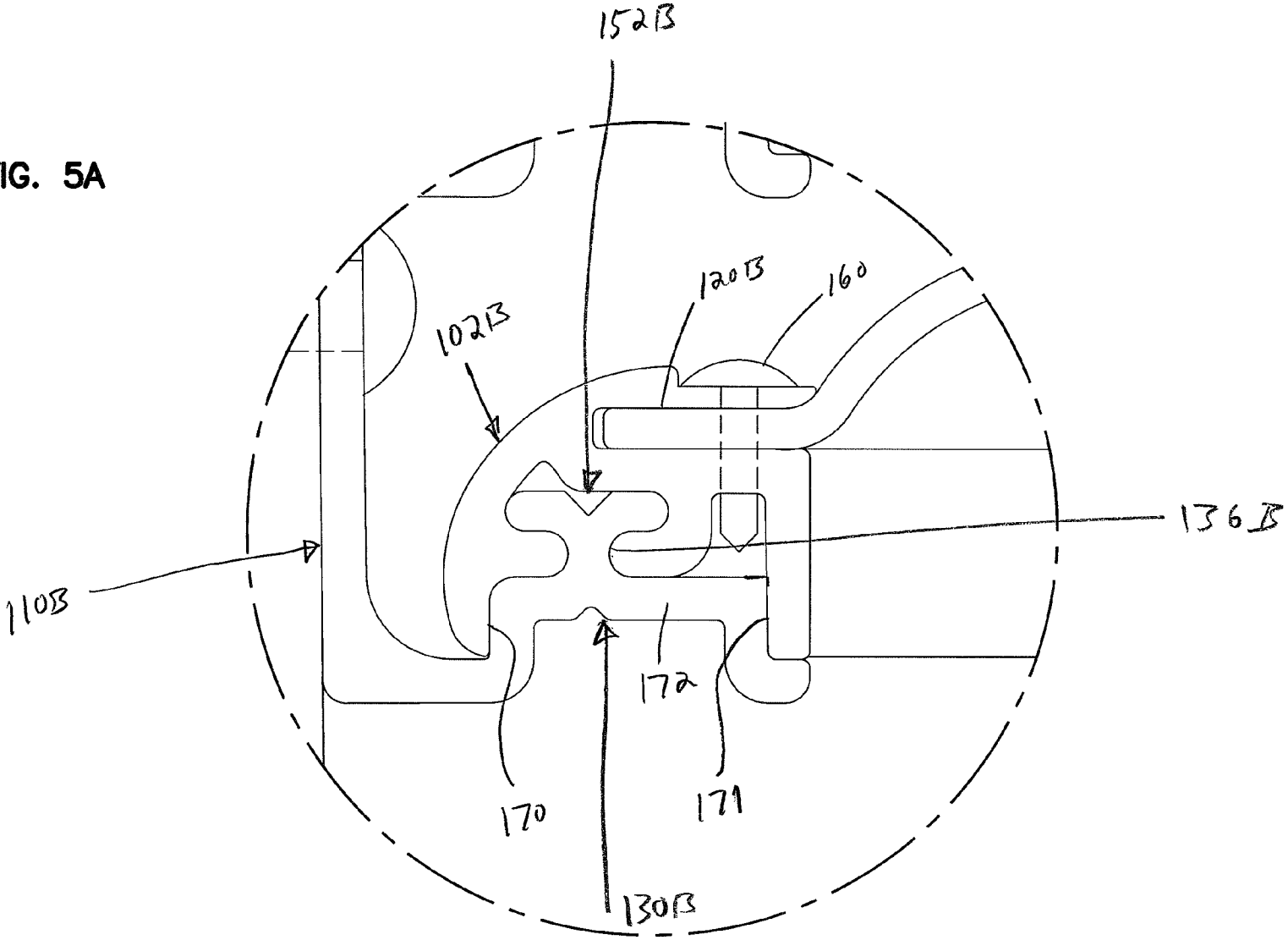
FIG. 5A is a close up view of a portion of the boat cover assembly shown in FIG. 5.

The port and starboard extrusions 110B, 112B each include upper and lower tracks 130B that are vertically spaced from one another. The upper tracks 130B form a port and starboard set of tracks on which the front cover section 44B is slidably mounted and the lower tracks 130B form a port and starboard set of tracks on which the aft cover section 46B is slidably mounted. The tracks 130B include male portions 136B having a generally T-shaped transverse cross-sectional shape. The perimeter frames 102B of the front and aft cover sections 44B, 46B have port and starboard slider segments that are elongated and that define generally T-shaped transverse cross-sectional channels 152B in which the male portions 136B are received. The elongated slider segments defined by the port and starboard sides of the perimeter frame 102B also include spaced apart walls 170, 171 between which base portions 172 of the tracks 130B are captured, as shown in the close up view of FIG. 5A.

Referring back to FIG. 1, the pontoon boat 20 includes sidewalls 50 extending upwardly from the deck 24 to define a perimeter having a length dimension and a width dimension. In some embodiments, the cover assembly 22 is movable vertically relative to the deck 24 so as to function both as a bimini-type cover that is elevated over the deck 24 above head level (e.g. above six feet) so that boaters can move about under the cover assembly 22, and also as a protective cover to keep debris, rain, etc. out of the interior of the perimeter defined by the sidewalls 50 when the boat 20 is not in use. Providing such a cover assembly 22 eliminates the need for a separate cover that must be attached to the sidewalls 50 or otherwise attached to cover the interior of the perimeter defined by the sidewalls 50.

Figure 6:
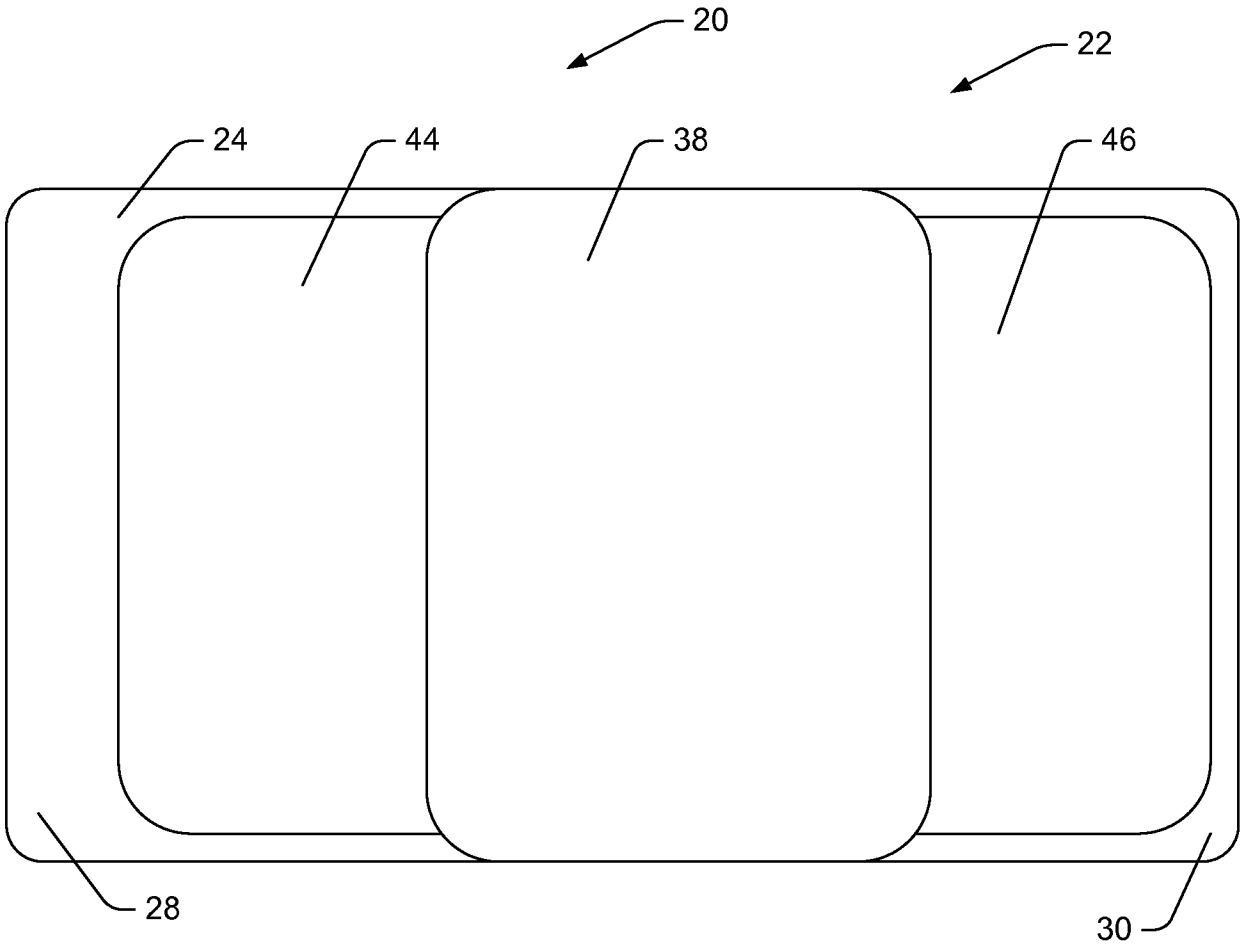
FIG. 6 is a top view showing a pontoon boat including a boat cover assembly in accordance with further principles of the present disclosure.

FIG. 6 is a top view of the boat 20 illustrating an example of the cover assembly 20 in the extended position. In the extended position shown in FIG. 6, the cover assembly defines a perimeter having a length dimension and a width dimension generally matching the length and width dimensions of the perimeter defined by the sidewalls 50, such that the cover assembly 22 covers the sidewalls 50 and the interior portion of the perimeter defined there by.

Figure 7:
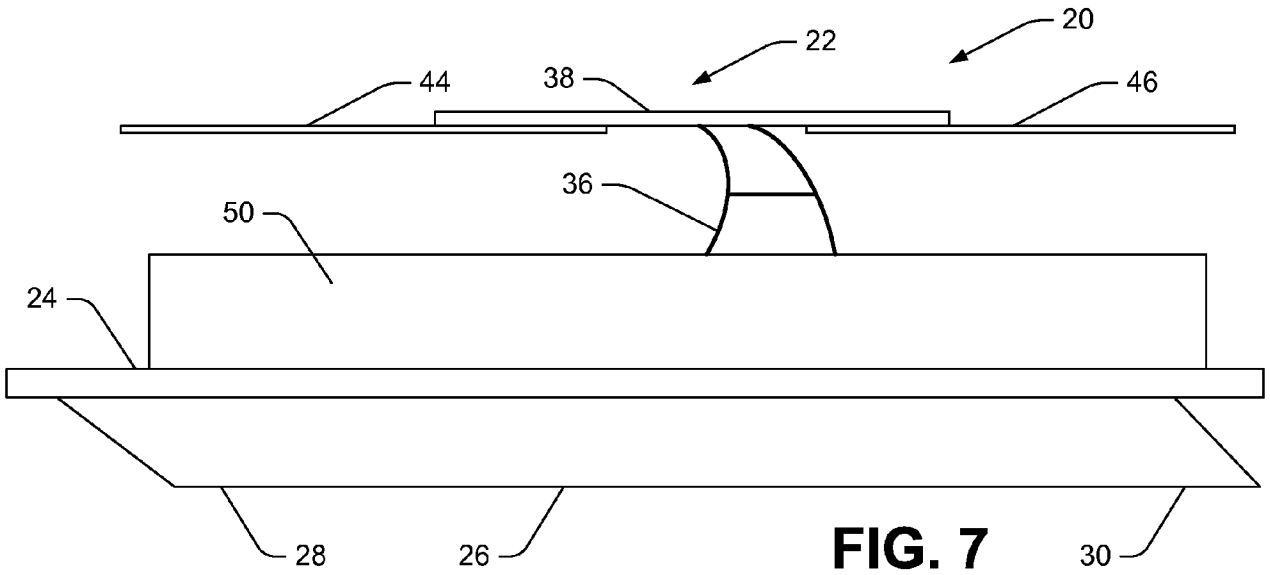
FIG. 7 is a side view showing the pontoon boat of FIG. 6 with the cover assembly in an up position.
Figure 8:
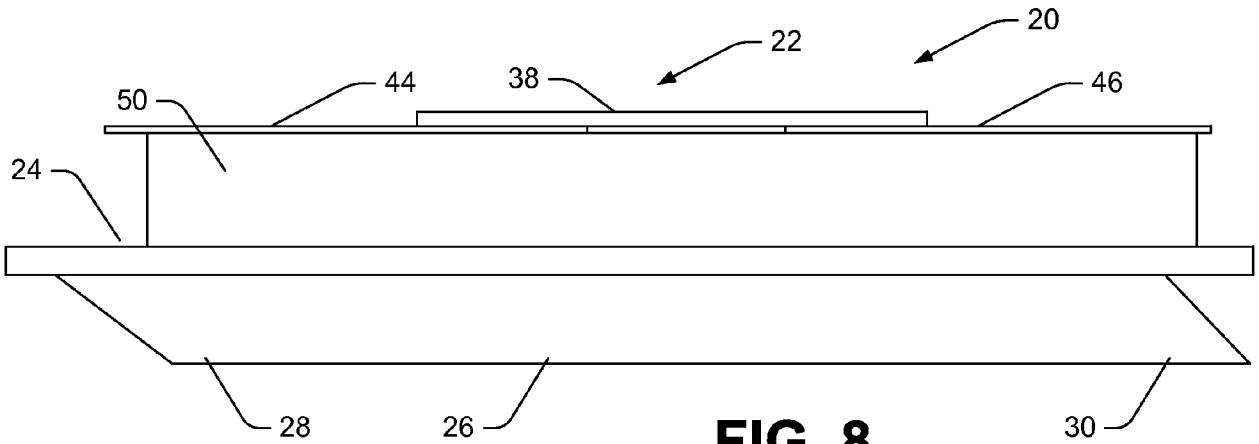
FIG. 8 is a side view showing the pontoon boat of FIG. 6 with the cover assembly in a down position.

FIGS. 7 and 8 are side views illustrating the cover assembly 22 in up and down positions, respectively. As shown in FIG. 7, the cover assembly 22 is elevated above head level. In the down position shown in FIG. 8, the cover assembly 22 is positioned on the sidewalls 50 to cover an area inside the perimeter defined by the sidewalls 50. In some examples, the frame structure 36 is movable so as to move the cover assembly 22 between the up position and the down position. In other examples, the cover assembly 22 is movably mounted to the frame structure 36 to move the cover 22 assembly between the up position and the down position.

The embodiments disclosed herein are intended to illustrate without limitation the utility and scope of the present disclosure. Those skilled in the art will readily recognize various modifications and changes that may be made to the embodiments without departing from the true spirit and scope of the disclosure.

What is claimed is:

1. A boat cover assembly that attaches to a frame structure configured for elevating the boat cover assembly over a deck of the boat, the boat cover assembly comprising:

a central cover section mounted to the frame structure, the central cover section including a front end and an aft end;

a front cover section having a front cover area defined by a perimeter of the front cover section, the front cover section being slidable relative to the central cover section between a retracted position where at least a majority of the front cover area is beneath the central cover section and an extended position where at least a majority of the front cover area extends forwardly from the front end of the central cover section, the front cover section being configured such that the front cover area does not change when the front cover section is slid between the retracted and extended positions;

an aft cover section having an aft cover area defined by a perimeter of the aft cover section, the aft cover section being slidable relative to the central cover section between a retracted position where at least a majority of the aft cover area is beneath the central cover section and an extended position where at least a majority of the aft cover area extends rearwardly from the aft end of the central cover section, the aft cover section being configured such that the aft cover area does not change when the aft cover section is slid between the retracted and extended positions; and wherein the aft cover section and the front cover section overlap one another when both the aft cover section and the front cover section are in the retracted position.

2. The boat cover assembly of claim 1, wherein the aft and front cover sections include an outer perimeter frame that supports a canvas cover structure.

3. The boat cover assembly of claim 1, wherein the aft and front cover sections have a hard panel construction.

4. The boat cover assembly of claim 1, wherein the central cover section is mounted to the frame structure so as to be stationary relative to the frame structure.

5. The boat cover assembly of claim 1, wherein when both the aft cover section and the front cover section are in the retracted position, one of the aft and the front cover sections is positioned between the central cover section and the other of the aft and front cover sections.

6. The boat cover assembly of claim 1, further comprising a slide system for slidably mounting the aft cover section and the front cover section to the frame structure such that the aft cover section and the front cover section slide linearly relative to the frame structure as the aft cover section and the front cover section are moved between the retracted and extended positions.

7. The boat cover assembly of claim 6, wherein the slide system includes first and second sets of port and starboard tracks secured to the frame, wherein the front cover section is slidably coupled to the first set of port and starboard tracks and the aft cover section is slidably coupled to the second set of port and starboard tracks.

8. The boat cover assembly of claim 7, wherein the front and aft cover sections each include port and starboard sides, wherein elongated port and starboard slide structures are respectively mounted at the port and starboard sides of the front and aft cover sections, wherein the port and starboard slide structures include downwardly facing channels that respectively receive the port and starboard tracks.

9. The boat cover assembly of claim 8, wherein the port and starboard tracks interlock with their respective port and starboard slide structures such that the front and aft cover sections are prevented from being vertically lifted from the port and starboard tracks.

10. The boat cover assembly of claim 8, wherein the port and starboard slide structures are situated between the front end and the aft end of the central cover section such that the port and starboard slide structures do not extend beyond the central cover section.

11. The boat cover assembly of claim 9, wherein the port and starboard slide structures each include lateral interlock projections received within corresponding lateral notches defined by the port and starboard tracks.

12. The boat cover assembly of claim 11, wherein the port and starboard tracks each include lateral interlock projections received within corresponding lateral notches defined by the port and starboard slide structures.

13. The boat cover assembly of claim 1, wherein, when in the extended position, the cover assembly defines a perimeter having a length dimension and a width dimension generally matching a length dimension and a width dimension of a perimeter defined by sidewalls extending from the deck of the boat.

14. The boat cover assembly of claim 13, wherein the cover assembly is vertically movable between an up position where the cover assembly is elevated above head level, and a down position where the cover assembly is positioned on the sidewalls to cover an area inside the perimeter defined by the sidewalls.

15. The boat cover assembly of claim 1, wherein the front cover section is supported only by the central cover section in both the retracted and extended positions, and wherein the aft cover section is supported only by the central cover section in both the retracted and extended positions.

16. A pontoon boat, comprising:

a deck supported by a plurality of sponsons;

sidewalls extending upwardly from the deck to define a perimeter having a length dimension and a width dimension;

a frame structure;

a cover assembly including:

a central cover section mounted to the frame structure, the central cover section including a front end and an aft end;

a front cover section having a front cover area defined by a perimeter of the front cover section, the front cover section being slidable relative to the central cover section between a retracted position where at least a majority of the front cover area is beneath the central cover section and an extended position where at least a majority of the front cover area extends forwardly from the front end of the central cover section, wherein the front cover section remains in a generally horizontal plane as the front cover section is moved between the extended and retracted positions; and an aft cover section having an aft cover area defined by a perimeter of the aft cover section, the aft cover section being slidable relative to the central cover section between a retracted position where at least a majority of the aft cover area is beneath the central cover section and an extended position where at least a majority of the aft cover area extends rearwardly from the aft end of the central cover section, wherein the aft cover section remains in a generally horizontal plane as the aft cover section is moved between the extended and retracted positions;

wherein the aft cover section and the front cover section overlap one another when both the aft cover section and the front cover section are in the retracted position;

wherein, when in the extended position, the cover assembly defines a perimeter having a length dimension and a width dimension generally matching the length and width dimensions of the perimeter defined by the sidewalls; and wherein the cover assembly is vertically movable between an up position where the cover assembly is elevated above head level, and a down position where the cover assembly is positioned on the sidewalls to cover an area inside the perimeter defined by the sidewalls.

17. The pontoon boat of claim 16, wherein the front cover section is configured such that the front cover area does not change when the front cover section is slid between the retracted and extended positions, and the aft cover section is configured such that the aft cover area does not change when the aft cover section is slid between the refracted and extended positions.

18. The pontoon boat of claim 16, wherein the frame structure is movable to move the cover assembly between the up position and the down position.

19. The pontoon boat of claim 16, wherein the cover assembly is movably mounted to the frame structure to move the cover assembly between the up position and the down position.

* * * * *